US010676246B2

(12) United States Patent
Smith

(10) Patent No.: US 10,676,246 B2
(45) Date of Patent: Jun. 9, 2020

(54) CLOSURE FOR CONTAINER

(71) Applicant: Berry Plastics Corporation, Evansville, IN (US)

(72) Inventor: Carl R. Smith, Perrysburg, OH (US)

(73) Assignee: BERRY PLASTICS CORPORATION, Evansville, IN (US)

( * ) Notice: Subject to any disclaimer, the term of this patent is extended or adjusted under 35 U.S.C. 154(b) by 121 days.

(21) Appl. No.: 15/861,052

(22) Filed: Jan. 3, 2018

(65) Prior Publication Data

US 2018/0186520 A1 Jul. 5, 2018

Related U.S. Application Data

(60) Provisional application No. 62/442,027, filed on Jan. 4, 2017.

(51) Int. Cl.

| | |
|---|---|
| ***B65D 41/04*** | (2006.01) |
| ***B65D 51/16*** | (2006.01) |
| ***B65D 41/32*** | (2006.01) |
| ***B65D 41/34*** | (2006.01) |

(52) U.S. Cl.

CPC ..... *B65D 41/0421* (2013.01); *B65D 41/325* (2013.01); *B65D 41/3428* (2013.01); *B65D 51/16* (2013.01); *B65D 51/1688* (2013.01); *B65D 41/0485* (2013.01)

(58) Field of Classification Search

CPC ..... B65D 51/00–1688; B65D 41/00–3428

See application file for complete search history.

(56) References Cited

U.S. PATENT DOCUMENTS

| | | | | |
|---|---|---|---|---|
| 6,325,226 | B1 | 12/2001 | Krautkramer | |
| 6,660,349 | B1 * | 12/2003 | Bourgeois | B29C 43/18 215/329 |
| 6,695,161 | B2 | 2/2004 | Kano | |
| 6,779,672 | B2 | 8/2004 | Kano | |
| 6,913,158 | B1 | 7/2005 | Boesl | |
| 7,014,055 | B2 | 3/2006 | Kano | |
| 8,240,491 | B2 | 8/2012 | Beecroft | |
| 8,268,216 | B2 | 9/2012 | Meador | |
| 8,534,476 | B2 | 9/2013 | Brozell | |
| 9,359,117 | B2 * | 6/2016 | Russell | B65D 51/1661 |
| 2001/0027957 | A1 * | 10/2001 | Kano | B65D 41/0421 215/341 |
| 2002/0074306 | A1 | 6/2002 | Krautkramer | |
| 2003/0141271 | A1 * | 7/2003 | German | B65D 41/3423 215/252 |

(Continued)

FOREIGN PATENT DOCUMENTS

WO 2013103946 7/2013

OTHER PUBLICATIONS

Blaine Copenheavery, Written Opinion of the International Searching Authority, Feb. 9, 2018, pp. 1-11 (Year: 2018).*

(Continued)

*Primary Examiner* — Kareen K Thomas

(74) *Attorney, Agent, or Firm* — Barnes & Thornburg LLP

(57) ABSTRACT

A canister includes a closure configured to mount on a container to close an open mouth into a product storage region formed in the container. The closure includes a lid and a lid retainer coupled to the lid. The lid retainer is configured to mate with an external thread on the container to retain the closure in a mounted position on the container.

19 Claims, 10 Drawing Sheets

(56) References Cited

U.S. PATENT DOCUMENTS

| | | | | |
|---|---|---|---|---|
| 2007/0144999 | A1* | 6/2007 | King | B65D 41/04 215/330 |
| 2009/0032486 | A1 | 2/2009 | Brozell | |
| 2013/0032596 | A1* | 2/2013 | Stonebraker | B29C 43/027 220/288 |
| 2013/0175285 | A1* | 7/2013 | Elliot | B65D 41/3423 220/797 |
| 2014/0021157 | A1* | 1/2014 | Gren | B65D 41/0421 215/252 |

OTHER PUBLICATIONS

International (PCT) Search Report and Written Opinion for International (PCT) Application No. PCT/US2018/012173 established Mar. 7, 2013, BP-507 PCT || 11 pages.

* cited by examiner

CLOSURE FOR CONTAINER

PRIORITY CLAIM

This application claims priority under 35 U.S.C. § 119(e) to U.S. Provisional Application Ser. No. 62/442,027, filed Jan. 4, 2017, which is expressly incorporated by reference herein.

BACKGROUND

The present disclosure relates to a closure, and particularly to a removable closure. More particularly, the present disclosure relates to a closure made from plastics materials.

SUMMARY

According to the present disclosure, a canister includes a closure and a container. The container is formed to include a product-receiving chamber therein. The closure is configured to mount to the container to block access to the product-storage region through an open mouth formed in the container.

In illustrative embodiments, the closure includes a lid and a series of gussets positioned annularly around the lid to reinforce the closure when the closure is installed on the container and under pressure. The gussets enable the lid to include a relatively thin top wall minimizing material included in the closure.

In illustrative embodiments, the side wall includes an annular band and a series of knurls coupled the annular band and positioned annularly around the lid to provide gripping and to reinforcement to the side wall when the closure is installed on the container and under pressure. The knurls enable the lid to include a relatively thin side wall.

In illustrative embodiments, the lid includes a lid retainer for retaining the lid onto the container. The lid retainer includes an internal thread and a series of speed bumps coupled to the internal threads to increase the force required to remove the closure from the container. The speed bumps block the closure from detaching from the container in an unintended manner due to excess pressure in the interior product-storage region not having been vented appropriately.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1 is an exploded assembly view of a canister in accordance with the present disclosure showing that the canister includes a closure including a lid comprising a thin top wall and a sidewall and a container including a filler neck, external threads coupled to the filler neck, and a body formed to include a product receiving chamber and suggesting that the closure may be coupled to the container to block access to the product-receiving chamber;

FIG. 2 is a sectional view taken along line 2-2 of FIG. 1 showing that the closure further includes an annular seal unit coupled to the thin top wall and a series of circumferentially spaced-apart gussets arranged to extend between the thin top wall and the sidewall to reinforce the thin top wall while the closure is under pressure and the lid further includes a lid retainer including internal thread that mate with the external thread of the container and a series of speed bumps coupled to the internal thread to control venting of pressure in the product receiving chamber during opening of the canister;

FIG. 3 is a view similar to FIG. 2 showing the closure coupled the container in an installed position and showing that the annular seal unit includes, from radially closest to a central axis to radially furthest from the central axis, an annular plug coupled to an inner surface of the thin top wall, an upper valve coupled to the thin top wall, and an outer valve coupled to the thin top wall and that the filler neck is received in and engages the annular seal unit to establish a first seal interface and a second seal interface, to block access to the interior product storage region;

FIG. 6 is an enlarged view taken from the circled region of FIG. 5 showing the relative locations of the gussets, knurls, annular plug, upper valve, and outer valve;

FIG. 6A is an enlarged view taken from the circled region of FIG. 3 showing the relative locations of the annular plug, upper valve, and outer valve in relation to the container to establish first and second seal interfaces;

Figure 1:
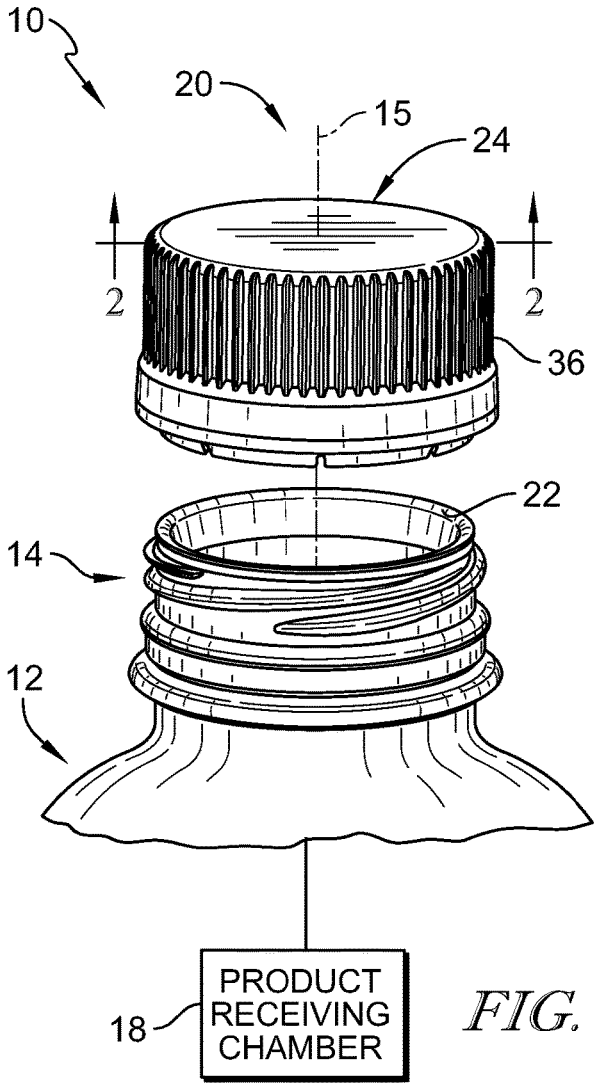
Figure 10:
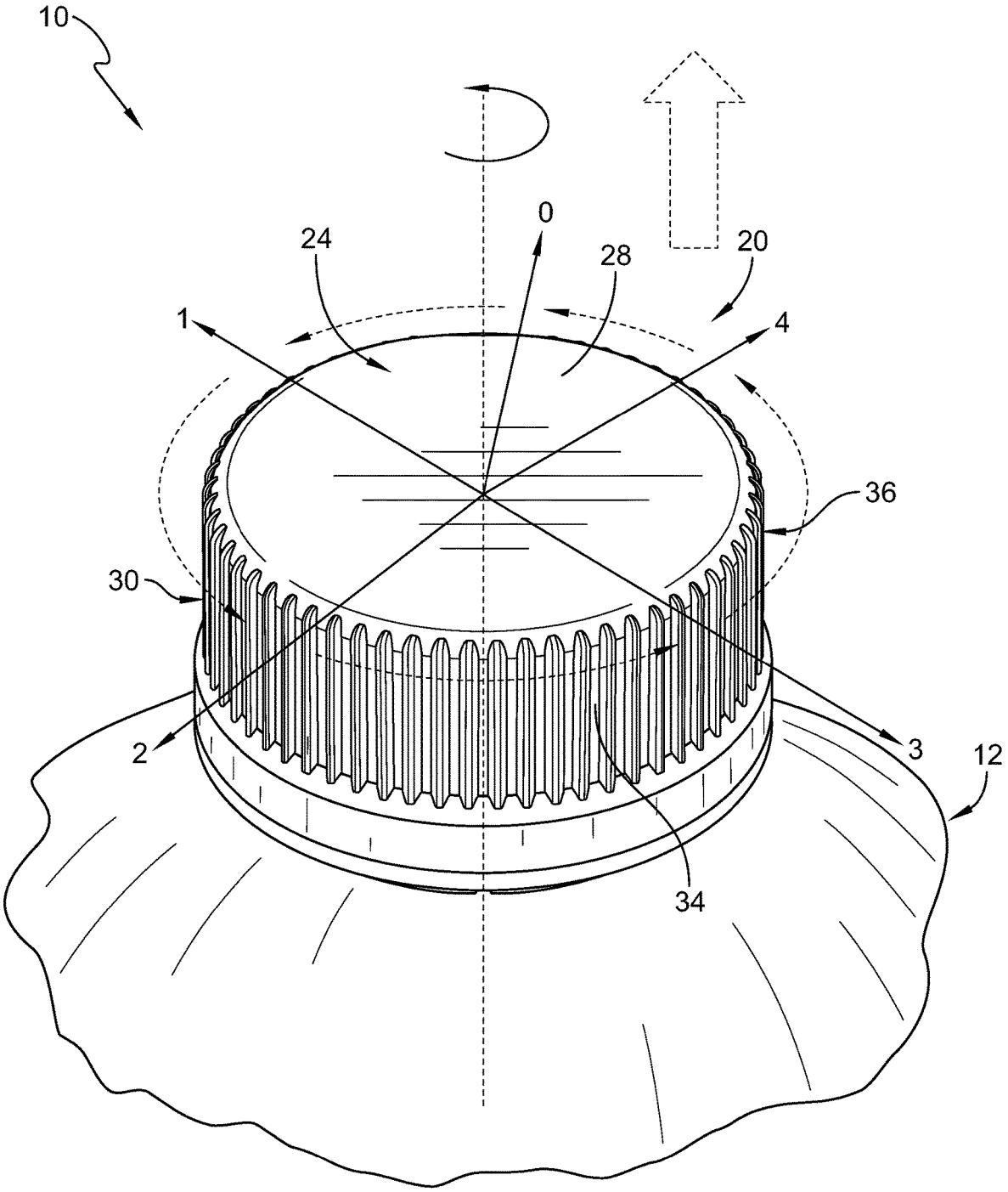
Figure 11:
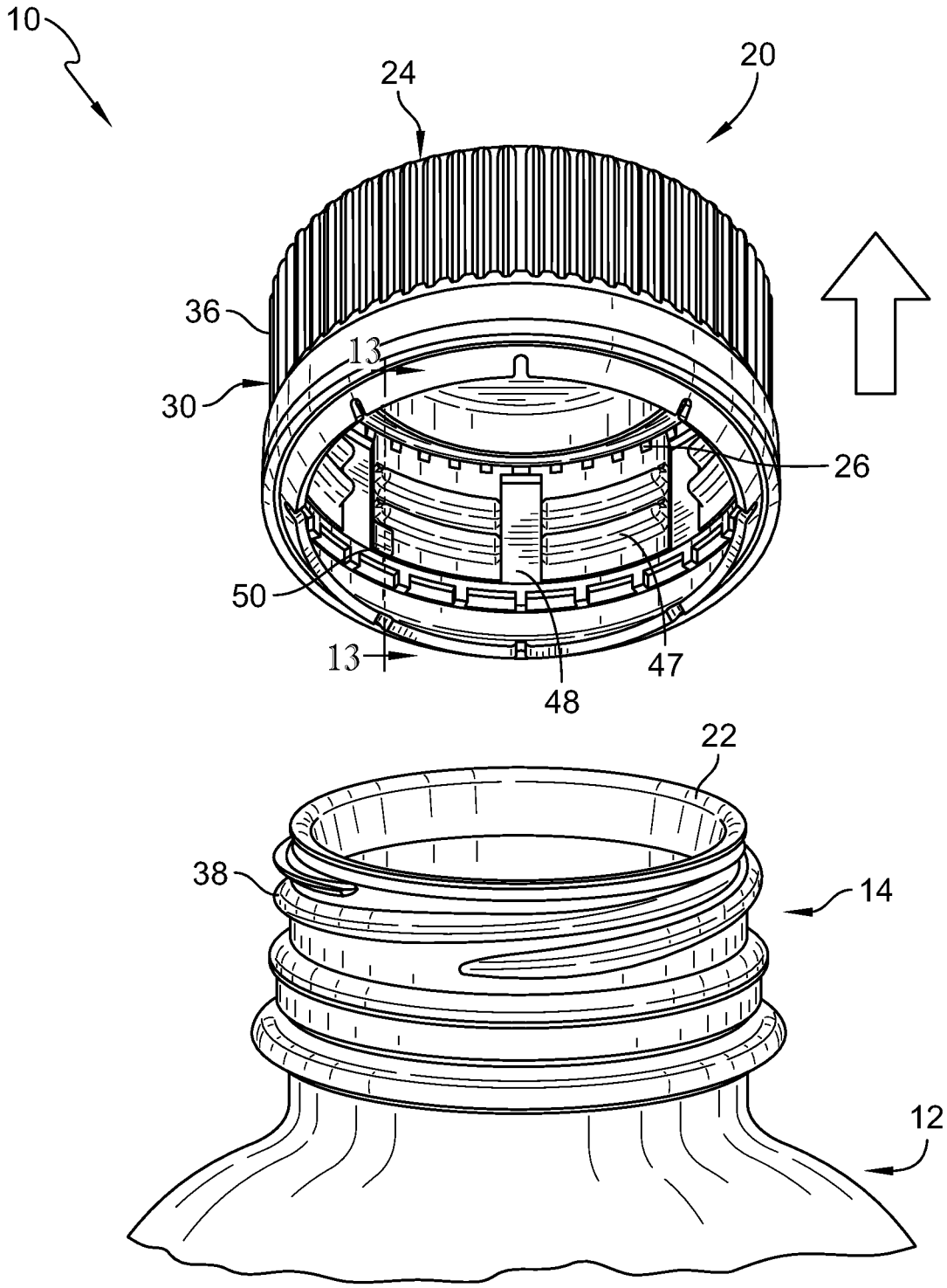
Figure 12:
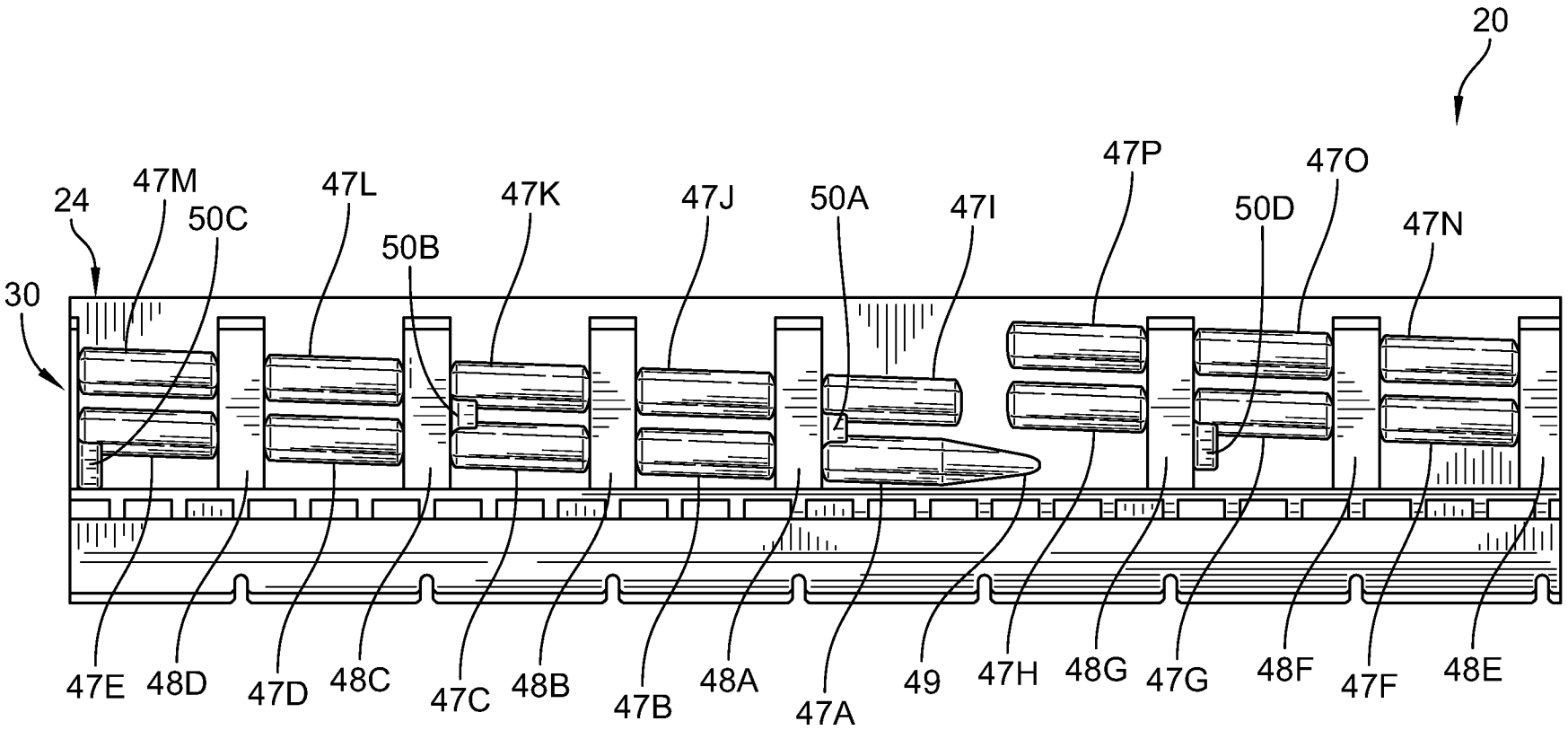
Figure 13:
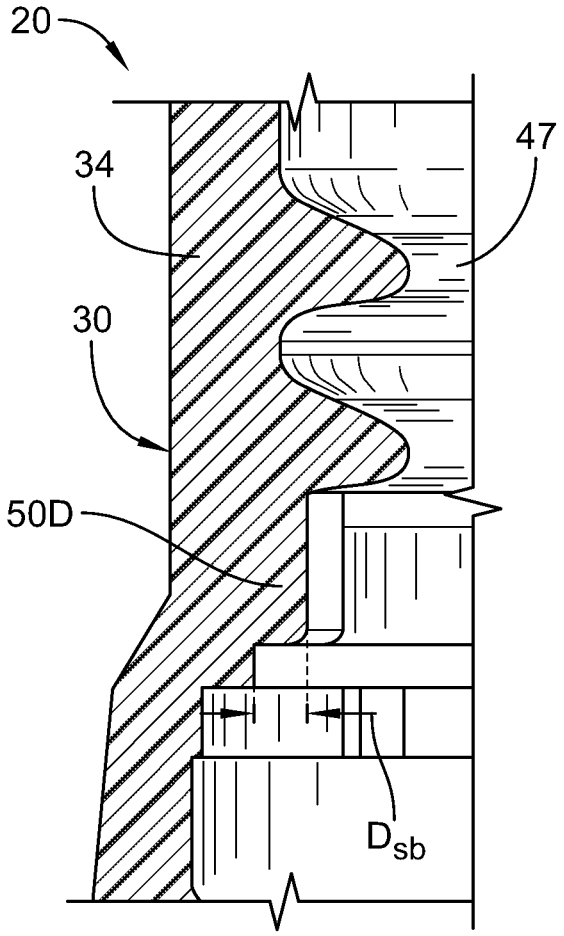

FIG. 10 is an enlarged partial perspective view of the canister of FIG. 1 showing the closure in the installed position on the container and suggesting that the closure moves toward the opened position to release pressure from the product receiving chamber in response to rotating in a counter-clockwise direction about the central axis in a series of movements starting at step 0 and moving through subsequent steps 1-4;

FIG. 11 is a view similar to FIG. 10 showing the canister in an opened arrangement in which the closure has been moved to the opened position and separated from the container after completing steps 1-4 in FIG. 10 and showing the internal thread coupled to the interior surface of the annular band and the series of speed bumps coupled to the interior surface of the annular band and positioned along the internal thread to control venting of pressure in the product receiving chamber during opening of the canister;

FIG. 12 is an enlarged flat diagrammatic view of the closure of FIG. 11 showing the sidewall, internal thread, and the series of speed bumps coupled to the internal thread and sidewall and arranged to control venting of pressure in the product receiving chamber during opening of the canister; and FIG. 13 is a sectional view taken along line 13-13 of FIG. 11 showing a thickness of the sidewall, the internal thread, and a thickness of one of the series of speed bumps.

DETAILED DESCRIPTION

Figure 2:
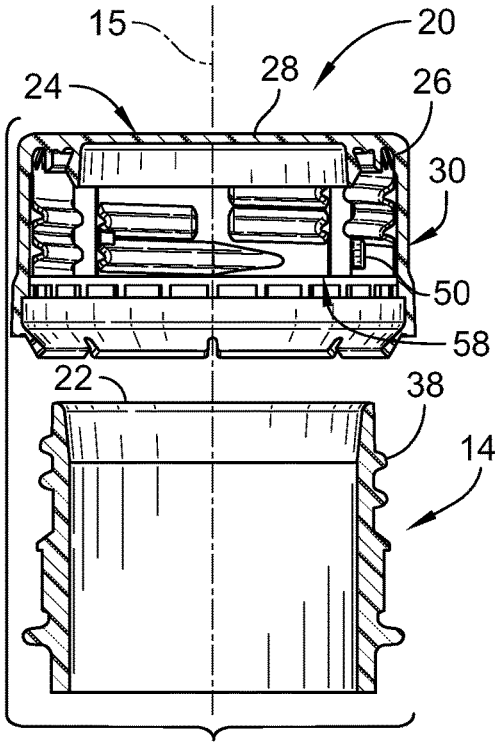
Figure 3:
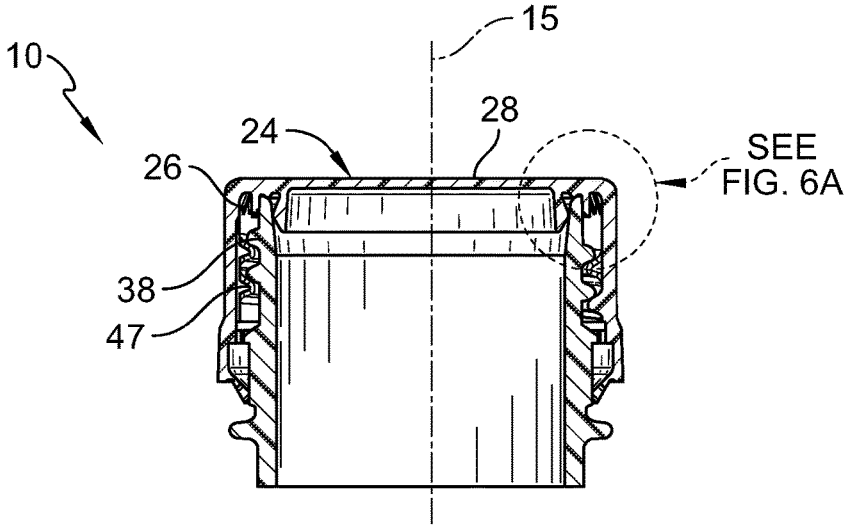
Figure 4:
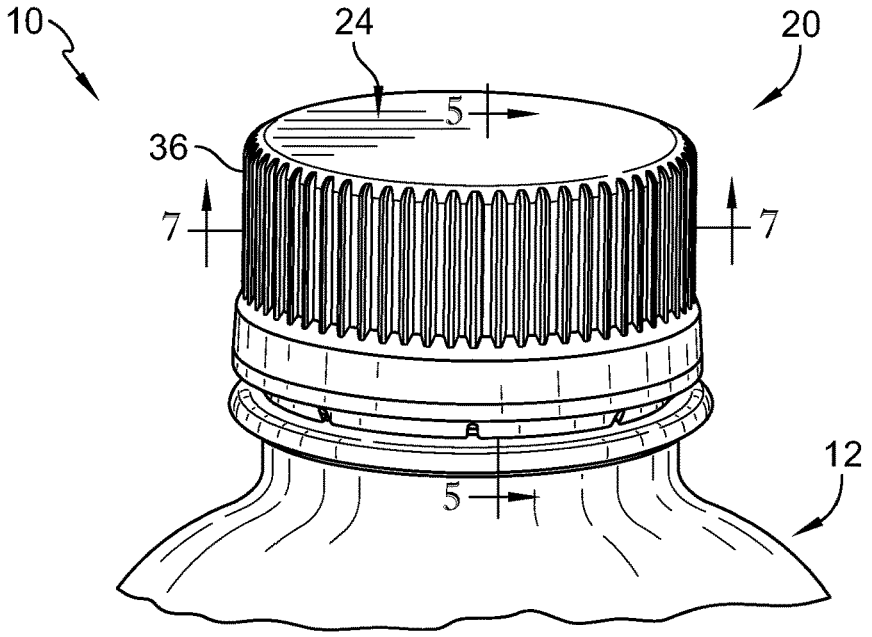
FIG. 4 is an enlarged partial perspective view of the canister of FIGS. 1-3 showing that the sidewall of the lid further includes an annular band arranged to extend downwardly from the thin top wall and a series of circumferentially spaced-apart knurls coupled to the annular band to provide a grip for a user during removal of the closure from the container.

A canister 10 in accordance with the present disclosure is shown, for example, in FIGS. 1-4. Canister 10 includes a container 12 and a closure 20 as shown in FIGS. 1-3. Closure 20 is separated from container 12 to allow access to a product receiving chamber 18 formed in container 12 through an open mouth 22 formed in the container 12, as shown, for example, in FIGS. 1 and 2. Closure 20 is coupled selectively to container 12 to close open mouth 22 and block access to product receiving chamber 18 as shown in FIGS. 3 and 4. Closure 20 includes a lid 24 having relatively thin walls which cooperate together to minimize material used during manufacturing while allowing closure 20 to withstand exposure to pressure exerted on canister 10 from pressured fluids stored in product receiving chamber 18.

Container 12 includes, for example, a filler neck 14 and a body 16, as shown in FIGS. 1 and 2. Filler neck 14 cooperates with body 16 to define product receiving chamber 18 therein. Open month 22 is formed in filler neck 14 and arranged to open into product receiving chamber 18 to allow communication with product receiving chamber 18 through open mouth 22. Closure 20 is configured to mount selectively on filler neck 14 of container 12 to cover open mouth 22 as suggested in FIG. 2 and shown in FIG. 3. Container 12 and closure 20 both share a common central axis 15 in a radially central location to container 12 and closure 20 as shown in FIGS. 1, 2, and 3.

Filler neck 14 is coupled to body 16 of container 12 and arranged to extend upwardly away from body 16 toward closure 20 as shown in FIG. 2. Filler neck 14 further includes an external thread 38 coupled to filler neck 14 to annularly line an outer surface of filler neck 14. When closure 20 is in the installed position, external thread 38 are located between filler neck 14 and closure 20 as shown in FIG. 3.

Figure 5:
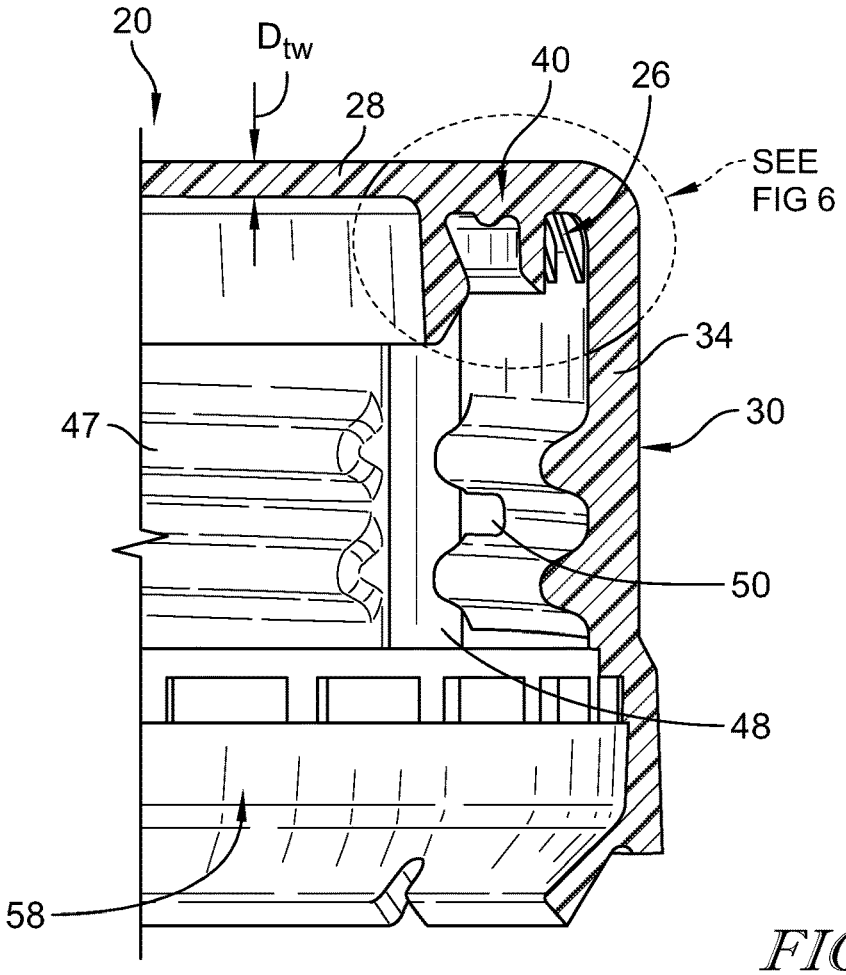
FIG. 5 is a sectional view taken along line 5-5 of FIG. 4 showing one of the series of knurls coupled to the sidewall and the one of the gussets extending between the thin top wall and the sidewall.

Closure 20 includes lid 24 and a series of gussets 26 that are coupled to the lid 24 as shown in FIG. 2. Lid 24 is formed to include a top wall 28 and a sidewall 30 coupled to top wall 28 and arranged to extend downward from top wall 28 toward container 12. Top wall 28 and sidewall 30 cooperate to define an interior region 58 formed in lid 24 which receives filler neck 14 therein when closure 20 is coupled to container 12. Gussets 26 are arranged to extend between and interconnect top wall 28 and sidewall 30 as shown in FIGS. 5 and 6.

Figure 6:
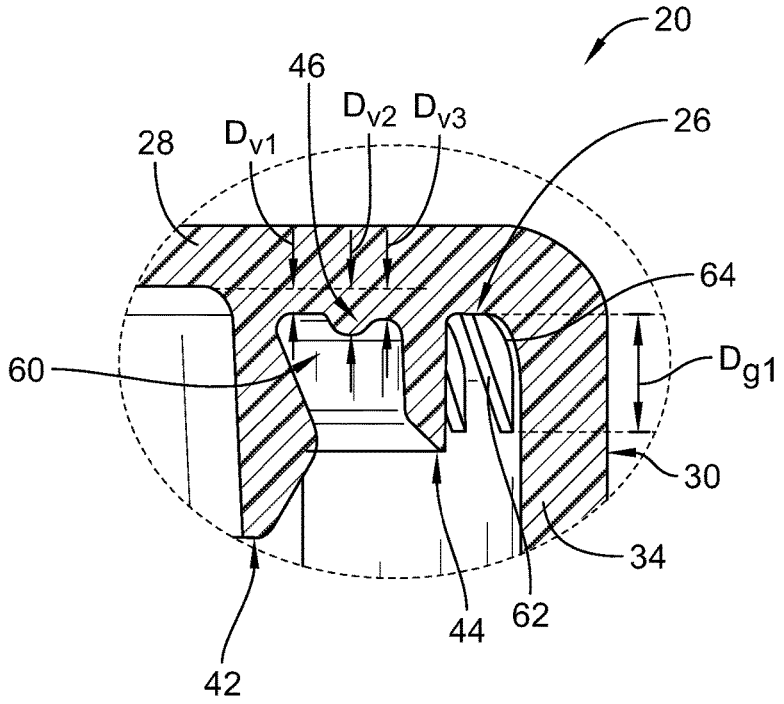
FIGS. 6 and 6A are enlarged views of an upper region of the closure.
Figure 7:
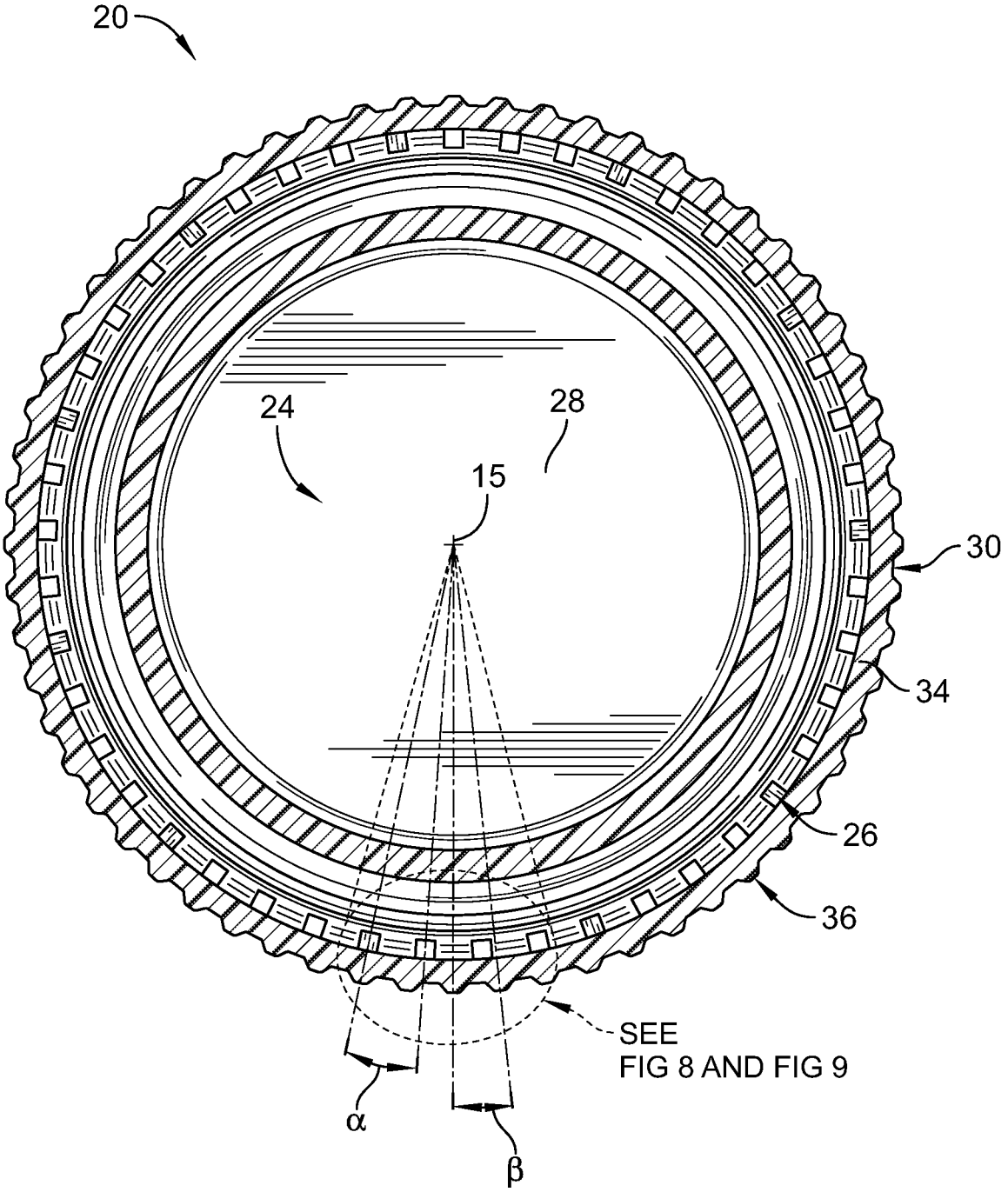
FIG. 7 is a sectional view taken along line 7-7 of FIG. 4 showing the series of circumferentially spaced-apart gussets and the series of circumferentially spaced-apart knurls.

Gussets 26 are spaced-apart from one another and arranged to extend around a circumference of top wall 28 and sidewall 30 as suggested in FIG. 6 and shown in FIG. 7. Gussets 26 are configured to reinforce top wall 28 of the lid 24 to minimize a thickness of top wall 28 so that closure 20 withstands pressure formed in product receiving chamber 18 when a pressurized fluid is stored therein and closure 20 is installed on container 12 closing open mouth 22 as suggested in FIGS. 3 and 4.

In one embodiment, the top wall 28 has a thickness of less than 0.06 inches. In another embodiment, the top wall 28 has a thickness of less than 0.05 inches. In another embodiment, the top wall 28 has a thickness of less than 0.04 inches. In another embodiment, the top wall 28 has a thickness of less than 0.03 inches. In another embodiment, the top wall 28 has a thickness $D_{tw}$ equal to 0.03 inches as shown in FIG. 8.

Each gusset 26 is formed to include a straight portion 62 and a curved portion 64 and shown in FIG. 6. Curved portion 64 is arranged to couple gusset 26 to closure 20. Straight portion 62 is arranged to extend between top wall 28 and sidewall 30 at an angle and face toward interior region 58. Straight portion 62 has a rectangular shape as shown in FIG. 6, however, any suitable shape may be used. Each gusset extends from top wall 28 down sidewall 30 a length $D_{g1}$ of about 0.062 inches as shown in FIG. 6, however, any other suitable length may be used. In one example, each gusset 26 has a width $D_{g2}$ of about 0.025 inches as shown in FIG. 8, however, any suitable width may be used. As such, each gusset 26 includes a width to height ratio of about 2 to about 5. However, any suitable width to height ratio may be used.

Figure 8:
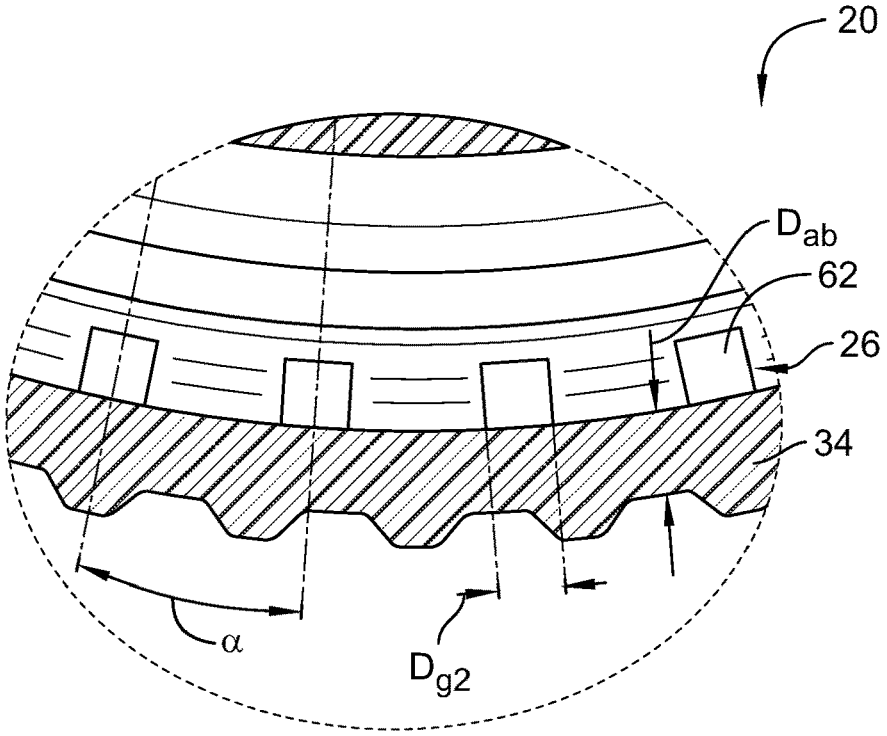
FIG. 8 is an enlarged view taken from the circled region of FIG. 7 showing dimensions of several of the circumferentially spaced-apart gussets.

In one example, each gusset 26 is spaced apart circumferentially from neighboring gussets 26 by an angle $\alpha$ of about 8 degrees around central axis 15 as shown in FIGS. 7 and 8. In another example, each gusset 26 is spaced apart circumferentially from neighboring gussets 26 by an angle $\alpha$ of about 6 degrees to about 12 degrees around central axis 15. In yet another example, the closure 20 may include groups of gussets 26 spaced circumferentially around the central axis 15 such that a gap is provided between adjacent groups of gussets 26. However, any suitable spacing between gussets 26 or groups of gussets 26 may be used. In one example, each straight portion 62 is extends from top wall 28 to sidewall 30 at an angle of about 18.7 degrees from sidewall 30, however any suitable angle may be used. Gusset 26 spacing, length, and width all cooperate to provide reinforcing to top wall 28 to provide minimum top wall 28 thickness while the closure 20 is mounted on container 12.

Figure 6A:
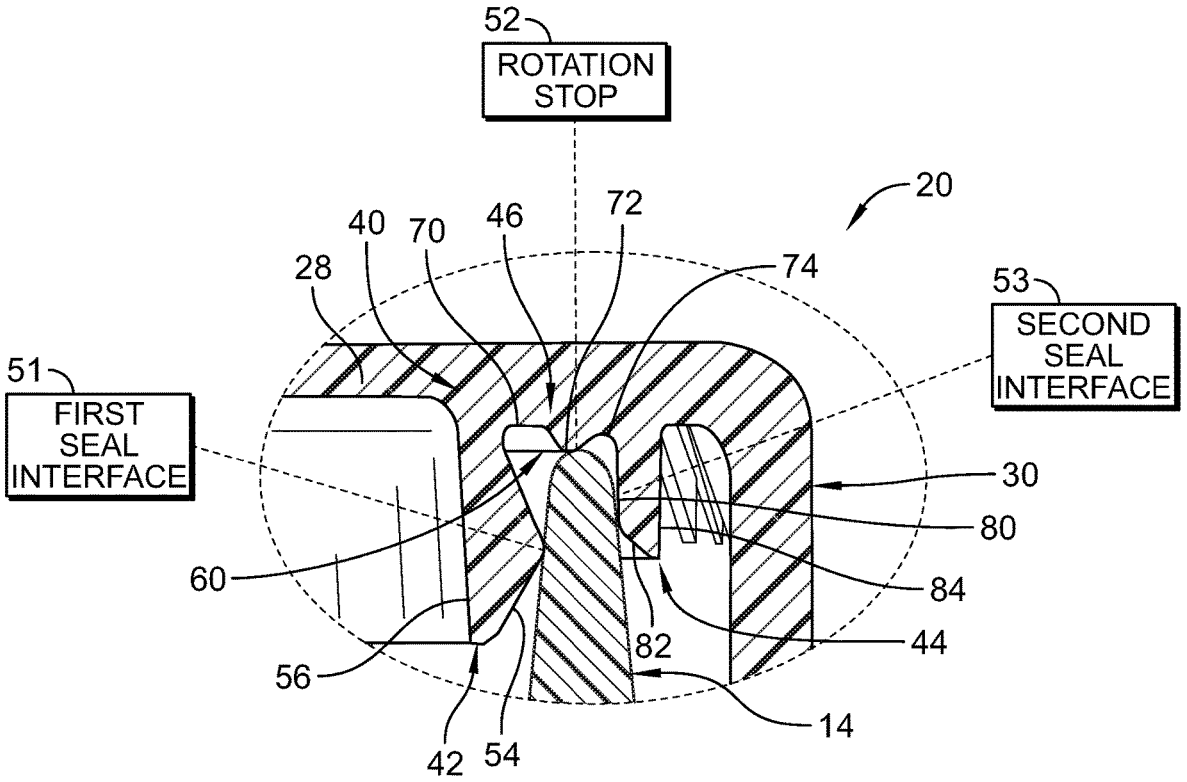

Closure 20 further includes an annular seal unit 40 as shown in FIGS. 5 and 6A. Annular seal unit 40 is coupled to top wall 28 of lid 24 as shown in FIGS. 5 and 6. Annular seal unit 40 is positioned to lie in spaced apart relation to annular sidewall 30 and configured to receive a portion of filler neck 14 therein when closure 20 is coupled to container 12 as shown in FIG. 6A.

Annular seal unit 40 includes an annular plug 42, an outer valve 44, and an upper valve 46 as shown in FIGS. 6 and 6A. Outer valve 44 is located in spaced-apart relation to annular plug 42. Upper valve 46 is located between annular plug 42 and outer valve 44 as shown in FIG. 6. Series of gussets 26 are located between outer valve 44 and sidewall 30 as shown in FIG. 6. Annular seal unit 40 is formed to include an annular receiving channel 60 therein. Annular receiving channel 60 is defined in part by top wall 28, annular plug 42, outer valve 44, and upper valve 46. Annular seal unit 40 receives filler neck 14 therein to block access to product receiving chamber 18 by establishing a first seal interface 51, a rotation stop 52 and a second seal interface 53 as shown in FIG. 6A.

First seal interface 51 is established along the inner surface of filler neck 14 when annular plug 42 extends into open mouth 22 as shown in FIG. 6A. Annular plug 42 is formed to include an outer seal surface 54 and an inner surface 56. Outer seal surface 54 is arranged to face toward and define a portion of annular receiving channel 60. Outer seal surface 54 also establishes first seal interface 51 when closure 20 has been installed onto container 12 and annular seal unit 40 has received filler neck 14.

Figure 6B:
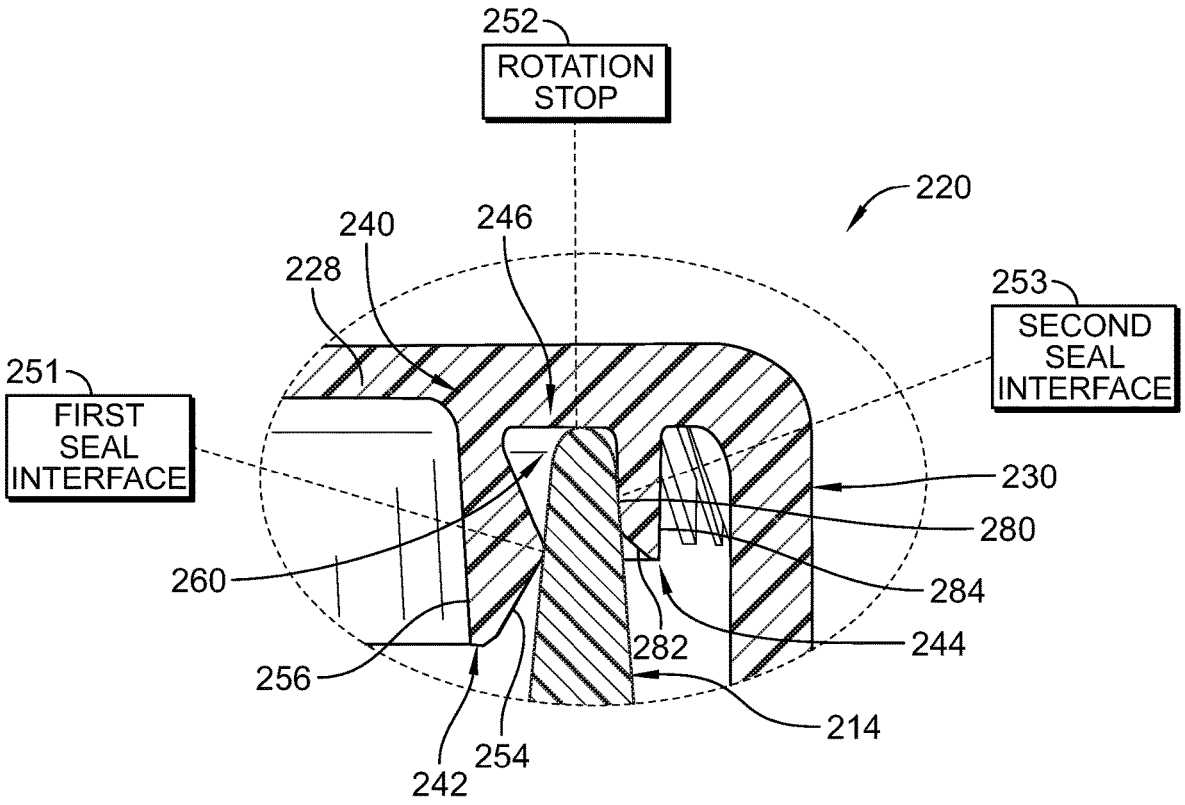
FIG. 6B is an enlarged view similar to FIG. 6A of a second embodiment of a closure in accordance with the present disclosure showing that the closure includes an upper valve that is generally flat.

Rotation stop 52 is restricts rotation of the closure 20 relative to the container 12 when the upper valve 46 engages the rotation stop 52 as shown in FIG. 6A. Upper valve 46 includes an annular disk 70 coupled to top wall 28, an inner ring 72, and an outer reinforcement ring 74. Annular disk 70 is coupled to top wall 28 and annular plug 42 and defines a portion of annular receiving channel 60. Annular disk 70 cooperates with outer seal surface 54 of annular plug 42 to establish a space within annular receiving channel 60 for annular plug 42 to pivot when closure 20 is installed and uninstalled as shown in FIG. 6A. In another embodiment, portions of the upper valve 46 may be removed as shown in FIG. 6B.

Inner ring 72 has a convex shape and engages filler neck 14 when closure 20 has been installed onto filler neck 14 as shown in FIG. 6A. Inner ring 72 is coupled to top wall 28 and annular disk 70 and defines a portion of annular receiving channel 60. Inner ring 72 is formed between annular disk 70 and outer reinforcement ring 74. Inner ring 72 is configured to engage filler neck 14 to provide rotation stop 52 as shown in FIG. 6A.

Outer reinforcement ring 74 has a concave shape and receives filler neck 14 as shown in FIG. 6A. Outer reinforcement ring 74 is coupled to top wall 28 between inner ring 72 and outer valve 44. Outer reinforcement ring 74 is formed with a different thickness relative to top wall 28 and annular disk 70 to minimize stress cracking caused by pressure within product receiving chamber 18.

In one example, annular disk 70 has a thickness that is less than 0.015 inches from top wall 28. In another example, annular disk 70 has a thickness $D_{v1}$ that is equal to 0.015 inches from top wall 28. In one embodiment, inner ring 72 has a thickness that is less than 0.027 inches from top wall 28. In another embodiment, inner ring 72 has a thickness $D_{v2}$ equal to 0.027 inches from top wall 28. In one embodiment, outer reinforcement ring 74 has a thickness that is less than 0.019 inches from top wall 28. In another embodiment, outer reinforcement ring has a thickness $D_{v3}$ equal to 0.019 inches from top wall 28.

Second seal interface 53 is established along the outer surface of filler neck 14 where outer valve 44 contacts filler neck 14 as shown in FIG. 6A. Outer valve 44 is formed to include inner seal surface 80, angled valve surface 82 and outer surface 84 as shown in FIG. 6. Inner seal surface 80 faces and defines a portion of annular receiving channel 60 and is formed to establish second seal interface 53 when closure 20 has been installed onto container 12 and annular seal unit 40 has received filler neck 14. Outer surface 84 is arranged to face toward sidewall 30 and gussets 26. Angled valve surface 82 is arranged to face toward annular receiving channel 60 and extends at an angle toward sidewall 30.

Another embodiment of a closure 220 in accordance with the present disclosure is shown in FIG. 6B. The closure 220 is similar to closure 20. As such, similar reference numbers to those used in the description of closure 20 are also used in the description of closure 220. Closure 220 is identical to closure 20 except that upper valve 246 is generally flat in comparison to upper valve 46 of closure 20. Rotation stop 252 is provided by the generally flat upper valve 246 when closure 220 is fully installed on the container 12 as shown in FIG. 6B.

Turning again to the first embodiment of the present disclosure, sidewall 30 of lid 24 includes an annular band 34 and a series of knurls 36 as shown in FIG. 7. Annular band 34 is coupled to top wall 28 and arranged to extend downwardly away from top wall 28 toward container 12 to extend around and surround filler neck 14 when closure 20 is installed on container 12 as shown in FIGS. 3 and 4. The series of knurls 36 are configured to reinforce annular band 34 to minimize a thickness of annular band 34 so that closure 20 withstands pressure formed in product receiving chamber 18 when the pressurized fluid is stored therein and closure 20 is installed on container 12 closing open mount 22 as suggested in FIGS. 3 and 4.

In one embodiment, annular band 34 has a thickness that is less than 0.04 inches. In another embodiment, annular band 34 has a thickness that is less than 0.03 inches. In another embodiment, annular band 34 has a thickness that is less than 0.022 inches. In another embodiment, annular band 34 has a thickness $D_{ab}$ that is equal to 0.022 inches as shown in FIG. 8.

Figure 9:
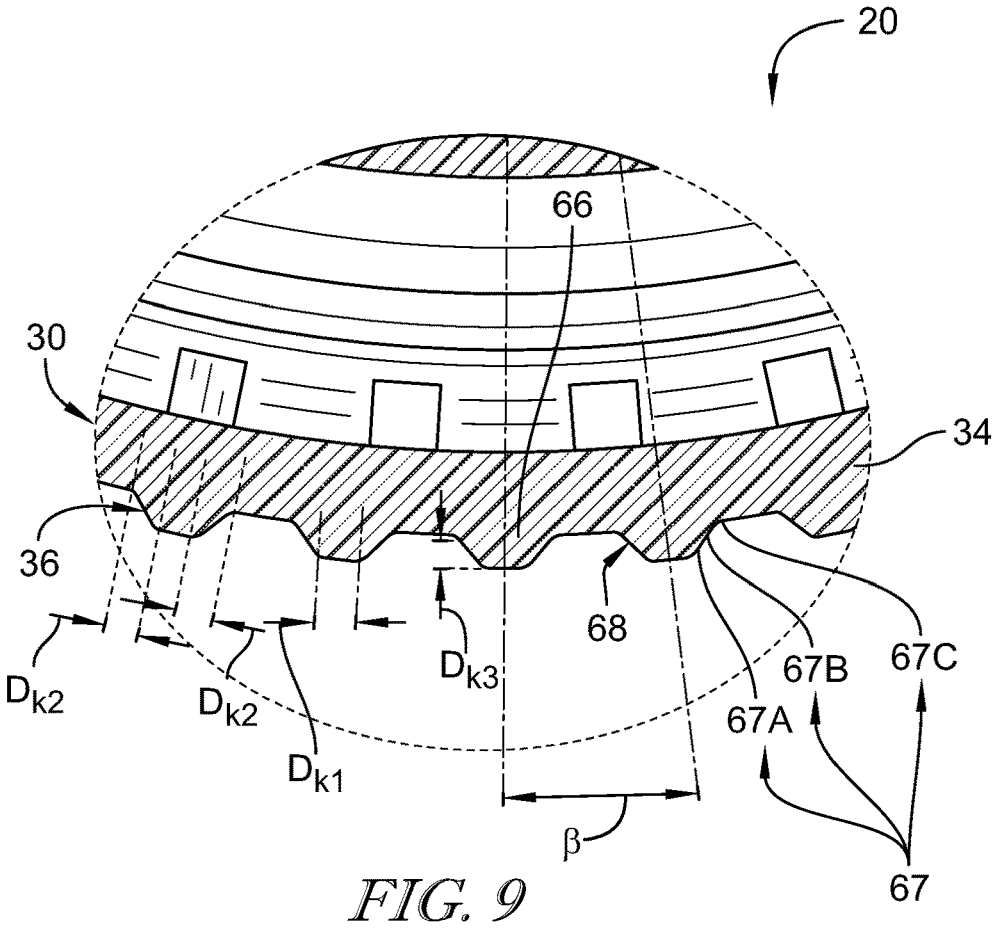
FIG. 9 is a view similar to FIG. 8 showing dimensions of several of the circumferentially spaced-apart knurls.

Series of knurls 36 are coupled to an outer surface of annular band 34 and arranged to extend outwardly away from annular band 34 and filler neck 14 as shown in FIGS. 7, 9, and 10. Series of knurls 36 are arranged to extend around annular band 34 and are configured to provide a grip for a user applying a torque to closure 20. The series of knurls 36 are coupled to annular band 34 and arranged to extend downwardly away from top wall 28 toward container 12 as shown in FIG. 10.

In one example, each knurl has a thickness less than 0.012 inches from the outer surface of the annular band 34. In another example, each knurl 36 has a thickness $D_{k3}$ of about 0.012 inches from the outer surface of the annular band 34 as shown in FIG. 9. In one example, each knurl 36 is spaced apart circumferentially from neighboring knurl 36 by an angle β of about 6 degrees around central axis 15 as shown in FIGS. 7 and 9.

Each knurl 36 is formed to include a knurl body 66, a first knurl shoulder 67 and a second knurl shoulder 68 as shown in FIG. 9. Knurl body 66 is formed to extend away from lid 24 and spaced apart from gussets 26 to find annular band 34 therebetween. Knurl body 66 is formed on each side by first and second knurl shoulders 67 and 68.

The disclosure relating to first knurl shoulder 67 is also applicable to second knurl shoulder 68, and thus, only first knurl shoulder 67 will be discussed in detail. First knurl shoulder 67 includes a first curved segment 67A, a straight segment 67B, and second curved segment 67C. First curved segment 67A forms part of the end of knurl 36 and is connected to straight segment 67B. Straight segment 67B forms one side of knurl 36 and extends from first curved segment 67A to second curved segment 67C. Second curved segment 67C forms part of the bottom of knurl 36 and is interconnected to first curved segment 67A by straight segment 67B which extends therebetween.

In one example, first curved segment 67A has a radius of curvature of about 0.007 inches, however, any suitable radius of curvature may be used. The radius of curvature of first curved segment 67A has a center that is radially closer to central axis 15 than first curved segment 67A. In one example, first curved segment 67A has a radius of curvature of about 0.007 inches, however, any suitable radius of curvature may be used. The radius of curvature of second curved segment 67C has a center that is radially farther from central axis 15 than first curved segment 67A.

In one example, first and second knurl shoulders 67, 68 have a width $D_{k2}$ of 0.01 inches across the outer surface of annular band 34 as shown in FIG. 9, however, any suitable length may be used. In one example, knurl body 66 has a width $D_{k1}$ of 0.016 inches across the outer surface of annular band 34 as shown in FIG. 9.

Lid 24 of closure 20 further includes a lid retainer 32. Lid retainer 32 is configured to couple selectively closure 20 onto the container 12. Lid retainer 32 includes internal thread 47, a series of valve passageways 48, and a series of speed bumps 50 as shown in FIGS. 11 and 12. Internal thread 47 is coupled to sidewall 30 of lid 24 and is configured to interact with external thread 38 of the filler neck 14 to cause lid 24 to close open mouth 22 when closure 20 is installed.

Lid retainer 32 may be disengaged from closure 20 by rotating the lid 24 in a counter-clockwise manner as shown in FIG. 10 by steps 0-4. Steps 0-4 indicate a venting process for pressure produced in product receiving chamber 18. When a user begins to rotate closure 20 through steps 0-4, pressure from product receiving chamber 18 is allowed to pass through open mouth 22 and out of canister 10 through valve passageways 48 as shown in FIG. 11.

Valve passageways 48 are formed in lid 24, as shown in FIG. 11, and are arranged to extend downwardly along sidewall 30 to provide a conduit through internal thread 47 to allow excess pressure to escape before closure 20 has been uninstalled from filler neck 14. Angled valve surface 82 is in communication with valve passageways 48 and is configured to allow pressurized fluid to flow around the outer valve 44 and through valve passageways 48 to provide controlled venting before the closure 20 has been completely uninstalled from container 12.

As shown in FIG. 12, internal thread 47 includes thread sections 47A, 47B, 47C, 47D, 47E, 47F, 47G, 47H, 47I, 47J, 47K, 47L, 47M, 47N, 47O, and 47P. Valve passageways 48A, 48B, 48C, 48D, 48E, 48F, and 48G form gaps along internal thread 47 to define each thread section. First thread section 47A includes a tapered thread start 49 appended on one end of first thread section 47A. Tapered thread start 49 is configured to align internal thread 47 with external thread 38 so that a user can install closure 20. Speed bumps 50 are positioned along internal thread 47 and configured to engage external thread 38 to increase the force required to uninstall closure 20 from filler neck 14 and block closure 20 from detaching in an uncontrolled manner from filler neck 14.

Four speed bumps 50A, 50B, 50C, and 50D are positioned along internal thread 47 as shown in FIG. 12. Each speed bump 50 extends from sidewall 30 into interior region 58 as shown in FIGS. 11 and 13. First speed bump 50A is coupled between first and ninth thread sections 47A and 47I and defines a portion of valve passageway 48A, as shown in FIG. 12. First and ninth thread sections 47A and 47I are positioned between tampered thread start 49 and valve passageway 48A. First thread section 47A is positioned below ninth thread section 47I. Valve passageway 48A is positioned between speed bump 50A and second and tenth thread sections 47B and 47J. Second and tenth thread sections 47B and 47J are positioned between valve passageways 48A and 48B. Second thread section 47B is positioned below tenth thread section 47J.

Second speed bump 50B is coupled between third and eleventh thread sections 47C and 47K and defines a portion of valve passageway 48C, as shown in FIG. 12. Third and eleventh thread sections 47C and 47K are positioned between valve passageways 48B and 48C. Third thread section 47C is positioned below eleventh thread section 47K. Valve passageway 48C is positioned between speed bump 50B and fourth and twelfth thread sections 47D and 47L. Fourth and twelfth thread sections 47D and 47L are positioned between valve passageways 48C and 48D. Fourth thread section 47D is positioned below twelfth thread section 47L. Speed bump 50B lies farther from container 12 than speed bump 50A.

Third speed bump 50C is coupled to a base portion of fifth thread section 47E and extends from fifth thread section 47E toward container 12 as shown in FIG. 12. Speed bump 50C defines a portion of valve passageway 48E. Fifth and thirteenth thread sections 47E and 47M are positioned between valve passageways 48D and 48E. Fifth thread section 47E is positioned below thirteenth thread section 47M. Valve passageway 48E is positioned between speed bump 50C and sixth and fourteenth thread sections 47F and 47N. Sixth and fourteenth thread sections 47F and 47N are positioned between valve passageways 48E and 48F. Sixth thread section 47F is positioned below fourteenth thread section 47N. Speed bump 50C lies closer to container 12 than speed bump 50A and speed bump 50B.

Forth speed bump 50D is coupled to a base portion of seventh thread section 47G and extends from seventh thread section 47G toward container 12 as shown in FIG. 12. Seventh and fifteenth thread sections 47G and 47O are positioned between valve passageways 48F and 48G. Seventh thread section 47G is positioned below fifteenth thread section 47O. Valve passageway 48G is positioned between speed bump 50D and eighth and sixteenth thread sections 47H and 47P. Eighth and sixteenth thread sections 47H and 47P are positioned between valve passageway 48G and thread sections 47A and 47I. Speed bump 50D lies farther from container 12 than speed bump 50C. Eighth thread section 47H is positioned below sixteenth thread section 47P. Speed bump 50D lies closer to container 12 than speed bump 50A and speed bump 50B.

In one example, speed bumps 50C and 50D have a thickness of less than 0.01 inches. In another example, speed bumps 50C and 50D have a thickness equal to 0.01 inches. In another example, speed bumps 50C and 50D have a thickness $D_{sb}$ equal to 0.009 inches as shown in FIG. 13, however, any suitable speed bump thickness may be used. In one example, speed bumps 50A and 50B have a thickness of less than 0.005 inches. In another example, speed bumps 50A and 50B have a thickness of 0.004 inches. In one example, the thickness is measured from annular band 34 to a radially inner edge of the selected speed bump 50 as shown in FIG. 13. In another example, the thickness is measured from a point along internal thread 47 to a radially inner edge of the selected speed bump 50.

Gussets are spaced-apart from one another and arranged to extend around a circumference of top wall and sidewall as suggested in FIG. 6 and shown in FIG. 7. Gussets are cooperate together to provide means for reinforcing top wall of the lid to minimize a thickness of top wall so that closure withstands pressure formed in product receiving chamber when a pressurized fluid is stored therein and closure is installed on container closing open mouth as suggested in FIGS. 3 and 4.

Sidewall of lid includes an annular band and a series of knurls as shown in FIG. 7. Annular band is coupled to top wall and gussets and arranged to extend downwardly away from top wall toward container to extend around and surround filler neck when closure is installed on container as shown in FIGS. 3 and 4. The series of knurls cooperate together to provide means for reinforcing annular band to minimize a thickness of annular band so that closure withstands pressure formed in product receiving chamber when the pressurized fluid is stored therein and closure is installed on container closing open mount as suggested in FIGS. 3 and 4.

The invention claimed is:

1. A canister comprising a container formed to include a product receiving chamber and a mouth arranged to open into the product receiving chamber, a closure coupled to the container in an installed position closing the mouth, and an annular seal unit coupled to the top wall and formed to include an annular receiving channel defined by an annular plug arranged to extend into the mouth and establish a first seal interface, an upper valve arranged to receive a filler neck of the container, and an outer valve, wherein the closure includes a lid having a top wall and a sidewall coupled to the top wall and arranged to extend downwardly away from the top wall toward the container, the lid and the sidewall cooperating to define an interior region formed in the lid, and a series of gussets coupled to the top wall and the side wall and located in the interior region, the series of gussets reinforcing the top wall to minimize a thickness of the top wall and so that the closure withstands pressure formed in the product receiving chamber when a pressurized fluid is stored in the product receiving chamber and the closure is in the installed position, and wherein the outer valve is configured to provide means for releasing excess pressure formed in the product storage region when the closure is being uninstalled from the filler neck.

2. The canister of claim 1, wherein the top wall has a thickness of less than 0.06 inches.

3. The canister of claim 2, wherein the top wall has a thickness of less than 0.04 inches.

4. The canister of claim 3, wherein the top wall has a thickness of less than 0.03 inches.

5. The canister of claim 4, wherein the top wall has a thickness of 0.03 inches.

6. The canister of claim 1, wherein each gusset included in the series of gussets is spaced-apart circumferentially from each neighboring gusset by eight degrees.

7. The canister of claim 1, further comprising a series of knurls coupled to the sidewall, the series of knurls being configured to provide a means for reinforcing the side wall to minimize a thickness of the side wall so that the closure withstands pressure formed in the product receiving chamber when the closure is in the installed position.

8. The canister of claim 7, wherein the series of knurls is coupled to the sidewall around an annular band.

9. The canister of claim 8, wherein the annular band has a thickness of less than 0.04 inches.

10. The canister of claim 9, wherein the annular band has a thickness of less than 0.03 inches.

11. The canister of claim 10, wherein the annular band has a thickness of 0.022 inches.

12. The canister of claim 7, wherein each knurl includes a body, a first shoulder, and a second shoulder, the body of each knurl arranged to extend away from the lid and positioned between the first shoulder and the second shoulder.

13. The canister of claim 1, wherein each gusset includes a straight portion extending between the top wall and the side wall at an angle relative to a central axis of the canister and a curved portion coupled to the top wall and the side wall to couple each gusset to the closure.

14. The canister of claim 1, wherein each gusset has a thickness and is spaced apart from neighboring gussets by a distance and the thickness of each gusset is smaller than the distance.

15. The canister of claim 1, wherein each gusset is spaced apart from the outer valve when the closure is in the installed position on the container.

16. A canister comprising a container formed to include a product receiving chamber and a mouth arranged to open into the product receiving chamber, a closure coupled to the container in an installed position closing the mouth, wherein the closure includes a lid having a top wall and a sidewall coupled to the top wall and arranged to extend downwardly away from the top wall toward the container, the lid and the sidewall cooperating to define an interior region formed in the lid, and a series of gussets coupled to the top wall and the side wall and located in the interior region, the series of gussets reinforcing the top wall to minimize a thickness of the top wall and so that the closure withstands pressure formed in the product receiving chamber when a pressurized fluid is stored in the product receiving chamber and the closure is in the installed position, and wherein the lid further includes a lid retainer coupled to the sidewall and formed to include internal threads, a series of speed bumps, and valve passageways, wherein the valve passageways are formed to include gaps in the internal threads to provide means for releasing excess pressure from the product receiving chamber.

17. The canister of claim 16, wherein the lid includes a first, second, third, and fourth speed bump coupled to the side wall and positioned along the internal threads to provide means for controlling the force required to uninstall the closure from the container.

18. The canister of claim 17, wherein the speed bumps have a thickness of less than or equal to 0.01 inches.

19. A closure comprising a lid having a top wall and a sidewall coupled to the top wall and arranged to extend downwardly away from the top wall toward the container, the lid and the sidewall cooperating to define an interior region formed in the lid, a series of gussets coupled to the top wall and the side wall and located in the interior region, the series of gussets configured to provide means for reinforcing the top wall to minimize a thickness of the top wall and so that the closure withstands pressure exerted on the top wall from inside the interior region of the lid, and an annular seal unit coupled to the top wall and formed to include an annular receiving channel defined by an annular plug arranged to extend into a mouth of a container and establish a first seal interface, an upper valve arranged to receive a filler neck of the container, and an outer valve configured to provide means for releasing excess pressure formed in the container when the closure is being uninstalled from the filler neck.

* * * * *